US010541097B2

(12) United States Patent
Hoffmann

(10) Patent No.: US 10,541,097 B2
(45) Date of Patent: Jan. 21, 2020

(54) ELECTROMECHANICAL RELAY, TERMINAL BLOCK, AND ELECTROMECHANICAL RELAY ASSEMBLY

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 16/317,017

(22) PCT Filed: Jul. 6, 2017

(86) PCT No.: PCT/EP2017/066997
§ 371 (c)(1),
(2) Date: Jan. 10, 2019

(87) PCT Pub. No.: WO2018/011060
PCT Pub. Date: Jan. 18, 2018

(65) Prior Publication Data

US 2019/0304722 A1 Oct. 3, 2019

(30) Foreign Application Priority Data

Jul. 11, 2016 (DE) ..... 10 2016 112 663

(51) Int. Cl.
*H01H 67/02* (2006.01)
*H01H 50/02* (2006.01)
(Continued)

(52) U.S. Cl.
CPC ..... *H01H 50/021* (2013.01); *H01H 50/047* (2013.01); *H01H 50/14* (2013.01); *H01H 50/24* (2013.01)

(58) Field of Classification Search
CPC ..... H01H 20/21; H01H 20/47; H01H 20/24
(Continued)

(56) References Cited

U.S. PATENT DOCUMENTS 6,046,661 A * 4/2000 Reger ..... H01H 50/56 335/185
6,661,319 B2 * 12/2003 Schmelz ..... H01H 1/26 335/128
(Continued)

FOREIGN PATENT DOCUMENTS

DE 2011858 A 2/1971
DE 19515358 A1 12/1995
(Continued)

OTHER PUBLICATIONS

Authorized Officer Nora Lindner, International Preliminary Report on Patentability issued in related PCT Application No. PCT/EP2017/066997 dated Jan. 24, 2019.
(Continued)

*Primary Examiner* — Alexander Talpalatski
(74) *Attorney, Agent, or Firm* — Kaplan Breyer Schwarz, LLP

(57) ABSTRACT

An electromechanical relay, which can be inserted into a modular terminal in an insertion direction, wherein the relay is arranged in a housing and has two toggle switches, each of which is connected to connecting elements. At least one of the connecting elements leads out of the housing at the side and extends perpendicular to the insertion direction in at least some segments.

14 Claims, 5 Drawing Sheets

(51) Int. Cl.

| | |
|---|---|
| ***H01H 50/24*** | (2006.01) |
| ***H01H 50/14*** | (2006.01) |
| ***H01H 50/04*** | (2006.01) |

(58) Field of Classification Search
USPC ..... 335/78, 129, 181
See application file for complete search history.

(56) References Cited

U.S. PATENT DOCUMENTS

| | | | | |
|---|---|---|---|---|
| 7,109,833 | B1 | 9/2006 | Pohl | |
| 7,659,800 | B2 * | 2/2010 | Gruner | H01H 1/26 335/185 |
| 7,710,224 | B2 * | 5/2010 | Gruner | H01H 51/2281 335/129 |
| 7,982,562 | B2 * | 7/2011 | Yang | H01H 1/28 335/129 |
| 8,203,403 | B2 * | 6/2012 | Moeller | H01H 51/2227 335/129 |
| 2009/0033446 | A1 * | 2/2009 | Gruner | H01H 1/26 335/129 |
| 2010/0182109 | A1 | 7/2010 | Kuo | |

FOREIGN PATENT DOCUMENTS

| | | | |
|---|---|---|---|
| DE | 19705508 | C1 | 8/1998 |
| DE | 202007004414 | U1 | 5/2007 |
| DE | 202014000905 | U1 | 2/2014 |
| DE | 112014001287 | T5 | 12/2015 |
| EP | 0147681 | A1 | 7/1985 |
| EP | 0521284 | A2 | 1/1993 |
| JP | 10-233149 | A | 9/1998 |
| JP | 2008-235064 | A | 10/2008 |
| JP | 2012-517093 | A | 7/2012 |
| JP | 2014-053077 | A | 3/2014 |
| JP | 2015-515097 | A | 5/2015 |
| WO | 2014/142247 | A1 | 9/2014 |

OTHER PUBLICATIONS

Office Action issued in German patent application No. 102016112663.2, dated Jul. 10, 2017, 5 pp.
Authorized Officer: Klein-Napora, Priscilla, International Search Report issued in PCT application No. PCT/EP2017/066997, dated Oct. 24, 2014, 13 pp.
Office Action issued in corresponding Japanese patent application No. 2019-500775, dated Aug. 14, 2019, 13 pp.
Office Action issued in corresponding Korean patent application No. 10-2019-7004039, dated Aug. 26, 2019, 8 pp.

* cited by examiner

ELECTROMECHANICAL RELAY, TERMINAL BLOCK, AND ELECTROMECHANICAL RELAY ASSEMBLY

FIELD

The invention relates to an electromechanical relay for insertion into a modular terminal, a modular terminal designed for insertion of an electromechanical relay and an electromechanical relay module comprising such an electromechanical relay and such a modular terminal.

BACKGROUND

DE 197 05 508 C1 discloses an electromechanical relay having a magnetic module with a rocker armature, an actuating module and two toggle switches situated in a plane. The connecting pins of the two toggle switches and the coil are designed with two rows on the base face of the housing of the electromagnetic relay. The known relay thus has twice the width in comparison with an electromechanical relay having a single toggle switch.

SUMMARY

The invention is based on the object of creating an electromechanical relay having two toggle switches in which the installation width need not be increased in comparison with an electromechanical relay having a single toggle switch, and a sufficient insulation and a minimum spacing can nevertheless be maintained to maintain the specified insulation between the connecting elements. The minimum spacing may amount to 5.5 mm, for example.

One aspect of the present invention may be regarded as creating a modular terminal, in which an electromechanical relay according to the invention having two toggle switches can be installed and connected electrically.

Another aspect may be regarded as creating an electromechanical relay module comprising an electromechanical relay according to the invention and a modular terminal according to the invention.

A core idea of the invention may be regarded as having at least one of the connecting elements of the toggle switches and/or the coil pass out through a side face or both side faces of the relay housing.

The technical problem described above is solved by the features of claim 1.

Accordingly, an electromechanical relay for insertion into a modular terminal is created. The relay has a magnetic system comprising a coil having a longitudinal axis, a coil core and an armature. The relay can be inserted into a modular terminal in a plug-in direction, i.e., an insertion direction, which runs at a right angle to the longitudinal axis of the coil. The armature is mounted in a first position and a second position, so that it is pivotable with respect to an axis running at a right angle to the longitudinal axis of the coil and at a right angle to the insertion direction. The electromechanical relay also has a housing comprising a first side face and a second side face opposite one another, each being arranged perpendicular to the longitudinal axis of the coil and each having a longitudinal axis running parallel to the insertion direction. In addition, the electromechanical relay has a first toggle switch, comprising two fixed contacts and one contact spring, wherein the contact spring has a stationary end and a segment that carries a contact element and is movable between the two fixed contacts. Furthermore, a second toggle switch having two fixed contacts and one contact spring is provided, wherein the contact spring has a stationary end and a segment being movable between the two stationary contacts and carrying a contact element, wherein the first toggle switch and the second toggle switch are arranged at different locations along the longitudinal axes of the first and second side faces inside the housing. In addition, the electromechanical relay has an actuating device, which couples the movable segments of the contact springs of the first and second toggle switches to the armature and is movable along the longitudinal axes of the side faces. The one fixed contact of the first toggle switch is connected to a first connecting element and the other fixed contact of the first toggle switch is connected to a second connecting element. The one fixed contact of the second toggle switch is connected to a third connecting element, while the other fixed contact of the second toggle switch is connected to a fourth connecting element. The stationary end of the contact spring of the second toggle switch is connected to a fifth connecting element, while the stationary end of the contact spring of the first toggle switch is connected to a sixth connecting element. The coil is connected to a seventh and eighth connecting element. The connecting elements each have an external segment situated outside the housing and may be embodied as connecting pins, for example. At least one of the connecting elements leads out of the first side face and at least one other connecting element leads out of the second side face. Alternatively, at least one of the connecting elements may lead out of one of the two side faces.

According to an advantageous refinement, the housing has a base face that is adjacent to the first and second side faces and is arranged at a right angle to the insertion direction. At least two of the connecting elements lead out of the first side face at separate outlet points, and at least two other connecting elements lead out of the second side face at separate outlet points.

The external segments of the connecting elements leading out of the first and second side faces each extend along the longitudinal axis of the coil for at least some segments. The separate outlet points of the first side face are different distances away from the base face, like the separate outlet points of the second side face. The external segments of the connecting elements leading out of the first side face each have an extent along the longitudinal axis of the coil that increases with the distance of the outlet points of the first side face from the base face. Similarly, the external segments of the connecting elements leading out of the second side face each have an extent along the longitudinal axis of the coil that increases with the distance of the outlet points of the second side face from the base face.

To increase the distances between the connecting elements and to be able to increase the electrical insulation between the connecting elements, the distance from the base face to the first toggle switch may be shorter than the distance from the base face to the second toggle switch. In this case, the fifth connecting elements which is connected to the stationary end of the contact spring of the second toggle switch leads out of the first side face; the third connecting element, which is connected to one of the fixed contacts of the second toggle switch leads out of the second side face; the fourth connecting element, which is connected to the other fixed contact of the second toggle switch leads out of the second side face; the first connecting element, which is connected to one of the fixed contacts of the first toggle switch leads out of the first side face. The external segments of the first and fifth connecting elements each extend along the longitudinal axis of the coil, wherein the external segment of the first connecting element is a shorter distance away from the base face than the external segment of the fifth connecting element, and wherein the external segment of the first connecting element is shorter along the longitudinal axis of the coil than the external segment of the fifth connecting element. Similarly, the external segments of the third and fourth connecting elements may each extend along the longitudinal axis of the coil such that the external segment of the fourth connecting element is a shorter distance away from the base face than the external segment of the third connecting element, and wherein the external segment of the fourth connecting element is shorter along the longitudinal axis of the coil than the external segment of the third connecting element.

A compact design can be achieved if the stationary end of the contact spring of the first toggle switch is arranged in proximity to the second side face, and the contact element of the movable segment of the contact spring of the first toggle switch and the fixed contacts of the first toggle switch are arranged in proximity to the first side face, while the stationary end of the contact spring of the second toggle switch is arranged in proximity to the first side face, and the contact element of the movable segment of the contact spring of the second toggle switch as well as the fixed contacts of the second toggle switch are arranged in proximity to the second side face.

In this way, the two contact springs may extend essentially parallel to one another over the entire length of the relay housing between the two side faces.

A symmetrical arrangement of the connecting elements can be achieved if the external segments of the first and fourth connecting elements lie in a first plane running essentially parallel to the longitudinal axis of the coil, while the external segments of the third and fifth connecting elements lie in a second plane running essentially parallel to the longitudinal axis of the coil. The first plane is a shorter distance away from the base face than the second plane.

To be able to further improve the distance and the electrical insulation between the connecting elements, the external segment of the second connecting element, which is connected to the other fixed contact of the first toggle switch, may lead out of the first side face at another outlet point and may extend in the insertion direction while the external segment of the sixth connecting element, which is connected to the stationary end of the contact spring of the first toggle switch leads out of the second side face at another outlet point and extends in the insertion direction. The additional outlet points are situated in a third plane running essentially parallel to the base face such that the third plane is a shorter distance away from the base face than the first plane.

A compact design can preferably be achieved by the fact that the actuating device has a first actuator and a second actuator. The first actuator being connected to the movable segment of the contact spring of the first toggle switch, and the second actuator being connected to the movable segment of the contact spring of the second toggle switch; the magnetic system, e.g., the coil or the coil core has a first end face which faces the first side face and a second end face that faces the second side face; the first actuator is arranged between the first side face and the first end face, and the second actuator is arranged between the second end face of the magnetic system and the second side face; and the armature is arranged between the first and second actuators and has a lift spring one end of which engages with the first actuator and the other end of which engages with the second actuator. The first and second actuators may each be designed in the form of a rod or post.

The external segments of the seventh and eighth connecting elements are preferably led out of the base face and extend in the insertion direction.

To obtain a compact design, the armature, the coil and the contact springs may be arranged in a sandwich structure, each having an elongated extent along the longitudinal axis of the coil.

In this way, the contact springs may be designed to be longer than in the prior art and may be arranged in such a way that a greater electrical insulation between the contact springs can be achieved than is the case with the known comparable approaches, such as those known from DE 197 05 508 C1, for example.

The aforementioned technical problem is also solved by the features of claim 10.

Accordingly, a modular terminal is provided for accommodating an electromechanical relay according to the invention having two toggle switches. The modular terminal has a housing with a recess designed to receive the relay. Connecting elements designed for electrical coupling to the connecting elements of the relay are arranged in the recess.

The technical problem defined above is also solved by the features of claim 11.

Accordingly, this creates an electromechanical relay module, which has a modular terminal according to the invention and an electromechanical relay according to the invention that can be coupled to one another electrically and mechanically. To do so, guide elements, which work together with complementary guide elements on the housing of the modular terminal when the relay is inserted into the modular terminal, may be arranged on the first and/or second side faces of the relay housing.

The housing of the electromechanical relay and the housing of the modular terminal preferably have essentially the same width such that the transverse axes of the first and second side faces each define the width of the housing of the electromechanical relay.

The housing of the electromechanical relay preferably has a width of 5 to 6 mm while the housing of the modular terminal has a width of 6 to 7 mm.

Thanks to the invention, the number of connecting elements of an electromechanical relay can be increased without having to alter the installation width.

BRIEF DESCRIPTION OF THE DRAWINGS

The invention will now be explained in greater detail below on the basis of an embodiment in combination with the accompanying drawings in which.

DETAILED DESCRIPTION

Figure 1:
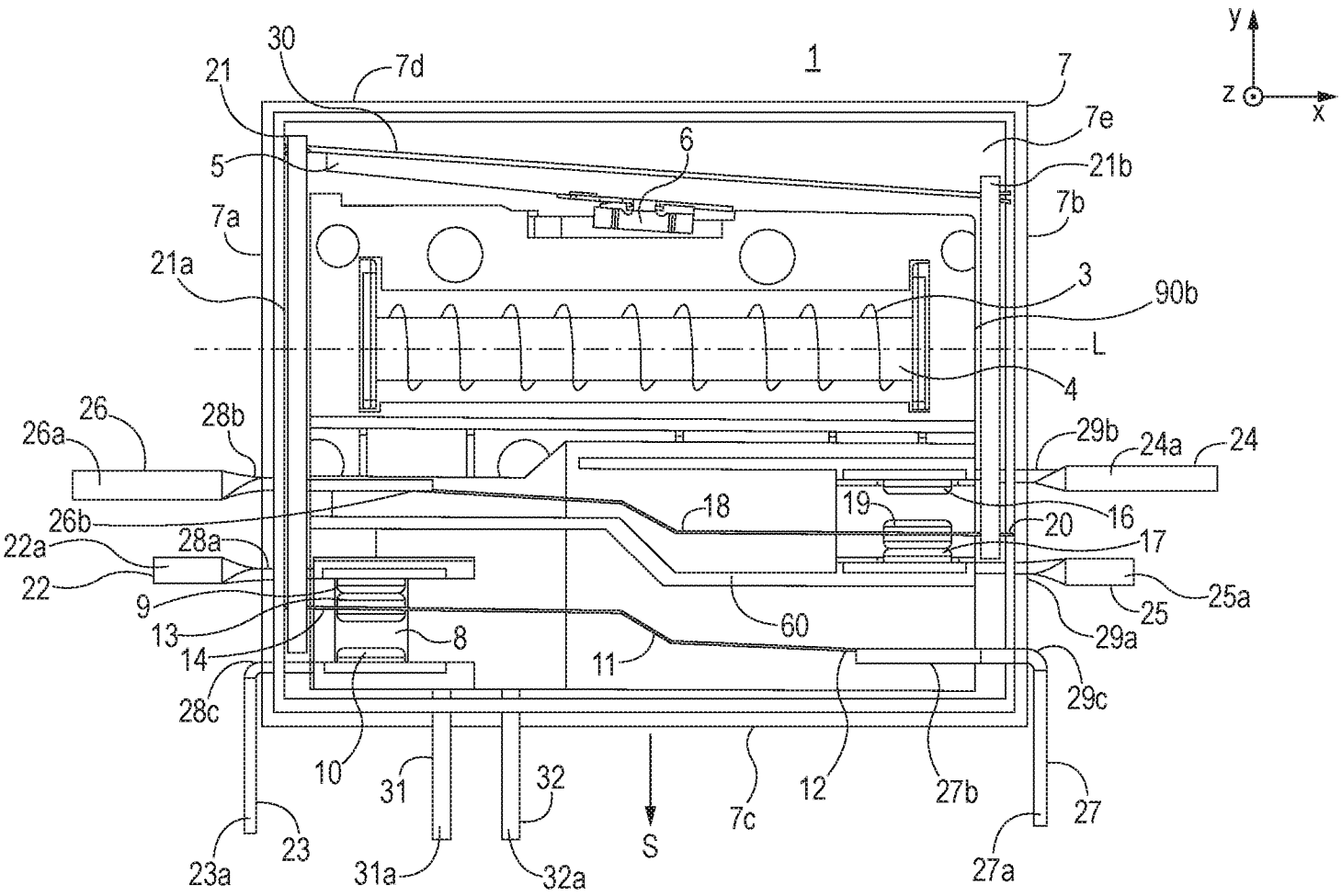
FIG. 1 shows a front view of an electromechanical relay according to the invention in the working position, wherein the front wall of the housing is removed.

To describe the positions better, FIG. 1 shows a 3D coordinate system, in which the z axis protrudes vertically out of the plane of the drawing.

Figure 7:
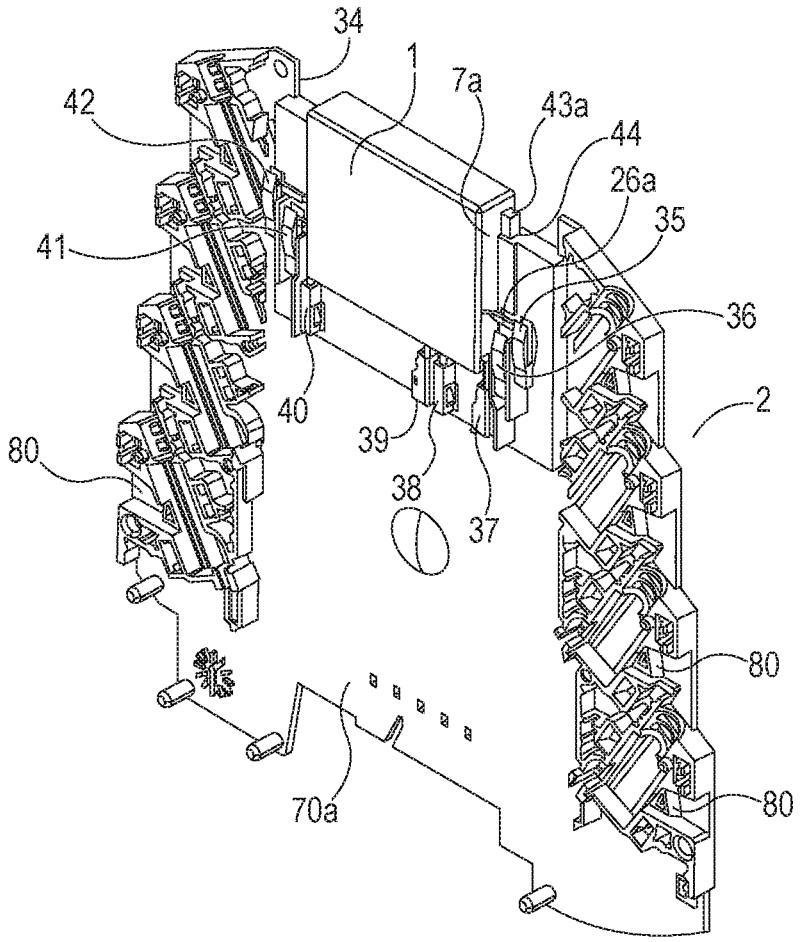
FIG. 7 shows a perspective view of the electromechanical relay module shown in FIG. 6 with the front terminal half-shell removed.

FIG. 1 shows an example of an electromechanical relay 1 for insertion into a modular terminal 2, as shown in detail in FIG. 7.

The electromechanical relay 1 has a magnetic system, which has a coil 3 with a longitudinal axis L, a coil core 4 and an armature 5. The longitudinal axis of the coil is shown as a broken line L in FIG. 1 running parallel to the x axis. For example, the armature 5 is in the working position, i.e., the coil 3 is current carrying, and the armature is driven. The relay 1 can be inserted into the modular terminal 2 in an insertion direction S running perpendicular to the longitudinal axis L of the coil 3. The insertion direction is represented in FIG. 1 by an arrow pointing in the −y direction.

The armature 5 is preferably a rocker armature mounted so that it can be pivoted into a first position and a second position with respect to an axis running perpendicular to the longitudinal axis L of the coil 3 and perpendicular to the insertion direction, i.e., in z direction of the coordinate system. A corresponding pivot bearing is labeled with reference numeral 6 in FIG. 1.

The electromechanical relay 1 is arranged in a housing 7 having a first side face 7*a* and a second side face 7*b* opposite one another, each arranged perpendicular to the longitudinal axis of the coil 3 and each having a longitudinal axis running parallel to the insertion direction. The side faces 7*a* and 7*b* thus lie in parallel planes, each spanned by the y axis and the z axis. The two side faces 7*a* and 7*b* each have a transverse axis of the width B pointing in −z direction and determining the installation width of the electromechanical relay 1. The installation width is preferably 5 to 6 mm.

A base face 7*c*, also referred to as the bottom surface, which is perpendicular to the insertion direction and has a longitudinal axis in x direction and a transverse axis in −z direction, may be adjacent to the two side faces 7*a* and 7*b*. The base face 7*c* may run parallel to the longitudinal axis of the coil 4 in at least some segments. The front wall of the housing 7 has been removed, while la back wall 7*e* and a top side 7*d* are illustrated.

The electromechanical relay 1 has a first toggle switch 8 which has two fixed contacts 9 and 10 and one contact spring 11. The contact spring 11 has a stationary end 12 and a segment 14 that carries a contact element 13 and can be moved between the two fixed contacts 8 and 9. The electromechanical relay 1 also has a second toggle switch 15 which in turn has two fixed contacts 16 and 17 as well as a contact spring 18. The contact spring 18 has a stationary end 20*b* and a segment 20 but carries a contact element 19 and can be moved between the two stationary contacts 16 and 17. The first toggle switch 8 and second toggle switch 15 are arranged along the longitudinal axis of the side faces 7*a* and 7*b*, i.e., along the y axis at different locations within the housing 7.

Furthermore, the electromechanical relay 1 has an actuating device 21, 21 and 21*b* which couples the movable segment 14 of the contact spring 11 of the first toggle switch 8 and the movable segment 20 of the contact spring 18 of the second toggle switch 15 to the armature 5. The actuating device 21 is movable back and forth along the longitudinal axes of the side faces 7*a* and 7*b*, i.e., in the y direction of the coordinate system.

The fixed contact 9 of the first toggle switch 8 is connected to a first connecting element 22. The other fixed contact 10 of the first toggle switch 8 is connected to a second connecting element 23. The fixed contact 16 of the second toggle switch 15 is connected to a third connecting element 24. The other fixed contact 17 of the second toggle switch 15 is connected to a fourth connecting element 25. The stationary end 19 of the contact spring 18 of the second toggle switch 15 is connected to a fifth connecting element 26. The stationary end 12 of the contact spring 11 of the first toggle switch 8 is connected to a sixth connecting element 27. The coil 3 preferably has two terminals which are connected to a seventh connecting element 31 and/or an eighth connecting element 32, respectively. The connecting elements 22 through 27, 31 and 32 each have an external segment situated outside of the housing 7.

The connecting element 22 therefore has an external segment 22*a*, the connecting element 23 has an external segment 23*a*, the connecting element 24 has an external segment 24*a*, the connecting element 25 has an external segment 25*a*, the connecting element 26 has an external segment 26*a*, the connecting element 27 has an external segment 27*a*, the connecting element 31 has an external segment 31*a*, the connecting element 32 has an external segment 32*a*. At least one of the connecting elements, for example, connecting element 26 leads out of the first side face 7*a* while at least one other connecting element, for example, connecting element 24 leads out of the second side face 7*b*. Alternatively, at least one of the connecting elements 22 through 27, 31 and 32 may lead out of one of the two side faces 7*a* to 7*b*.

Preferably at least two connecting elements lead out of the first side face 7*a* at separate outlet points 28*a* and 28*b*. The outlet points 28*a* and 28*b* may be implemented [formed] by openings in the side face 7*a*. For example, the connecting elements 22 and 26 may lead out of the first side face 7*a*. Similarly, at least two other connecting elements, for example, connecting elements 24 and 25 may lead out of the second side face 7*b* at separate outlet points 29*a* and 29*b*. The outlet points 28*a* and 28*b* may in turn be implemented by openings in the side face 7*a*.

The external segments 22*a* and 26*a* of the connecting elements 22 and 26 led out of the first side face 7*a* and the external segments 24*a* and 25*a* of the connecting elements 24 and 25 led out of the second side face 7*b* each extend at least in some segments along the longitudinal axis of the coil 3, i.e., in x and/or −x directions. The separate outlet points 28*a* and 28*b* of the first side face 7*a* are different distances from the base face 7*c*. For example, outlet point 28*a* is a shorter distance away from the base face 7*c* than outlet point 28*b*. The separate outlet points 29*a* and 29*b* of the second side face 7*b* are different distances from the base face 7*c*. For example, the outlet point 29*a* is a shorter distance away from the base face 7*c* than the outlet point 29*b*.

The external segments 22*a* and 26*a* of the connecting elements 22 and 26 lead out of the first side face 7*a* each have an external extent along the longitudinal axis of the coil 3, i.e., in −x direction, which increases with the distance of the outlet points 22*a* and 26*a* of the first side face 7*a* to the base face 7*c*. In other words, since the distance of the external segment 22*a* from the base face 7*c* is less than that of the external segment 26*a*, the external segment 22*a* extends further in the −x direction than the external segment 22*a*, beginning at the side face 7*a*.

The same is also true of the external segments 24*a* and 25*a*. The external segments 24*a* and 25*a* of the connecting elements 24 and 25 led out of the second side face 7*b* each have an extent along the longitudinal axis of the coil 3, i.e., in x direction, which increases with the distance of the outlet points 24*a* and 25*a* of the second side face 7*b* from the base face 7*c*. In another words, since the distance of the external segment 25*a* from the base face 7*c* is shorter than that of the external segment 24*a*, the external segment 24*a* extends further in x direction than the external segment 25*a*, beginning at the side face 7*b*.

For example, in the case of the connecting elements 22, 24, 25 and 26, if one were concerned about elongated connecting pins extending only along the x axis, as shown in FIG. 1, then the external segment 22*a* is shorter than the external segment 26*a*, and the external segment 25*a* is shorter than the external segment 24*a*. In other words, the distance between the side face 7*a* and the outer end of the external segment 22*a* is shorter than the distance between the side face 7*a* and the outer end of the external segment 26*a*.

The actuating device 21 preferably has a first actuator 21*a* and a second actuator 21*b* each of which runs parallel to the insertion direction, i.e., they can be moved in y direction and −y direction. The actuators 21*a* and 21*b* may each be designed with a rod shape or post shape. The first actuator 21*a* is connected to the movable segment 14 of the contact spring 11 of the first toggle switch 8 in that, for example, the front end of the movable segment 14 is inserted into a slot or a corresponding opening in the first actuator 21*a*. Similarly, the second actuator 21*b* is connected to the movable segment 20 of the contact spring 18 of the second toggle switch 15 in that the end of the movable segment 20 leads in a slot 51 or an opening of the second actuator 21*b*.

Figure 4:
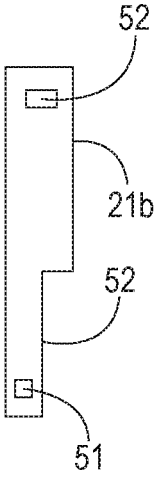
FIG. 4 shows a front view of the actuator shown in FIG. 1.

FIG. 4 shows as an example a top view of the actuator 21*b* having the slot 51. Furthermore, the actuator 21*b* may have an additional slot 51 into which one end of a stroke-limiting spring 30, which may be attached to the armature 5. The actuator 21*b* may have a recess 52 in the lower area, so that the actuator 21*b* can move unhindered past the connecting elements 24 and 25. The actuator 21*a* is designed like the actuator 21*b*, so that it can accommodate the other end of the stroke-limiting spring 30 and can pass unhindered by the connecting elements 22 and 26. The stroke-limiting spring 30 is slotted on both sides which engage with the actuator 21*a* and the actuator 21*b* and they are braced against one another. The contact force is therefore achieved by means of spreading of the stretched spring segments.

As shown in FIG. 1, for example, the distance of the first toggle switch 8 from the base face 7*c* is less than that of the second toggle switch 15 from the base face 7*c*. This yields the following arrangement as an example: the fifth connecting element 26 which is connected to the stationary end 20*b* of the contact spring 18 of the second toggle switch 15, leads out of the first side face 7*a* at the outlet point 28*b*. The third connecting element 24 which is connected to the fixed contact 16 of the second toggle switch 15 leads out of the second side face 7*b* at the outlet point 29*b*. The fourth connecting element 25 which is connected to the fixed contact 17 of the second toggle switch 15 leads out of the second side face 7*b* at the outlet point 29*a*. The first connecting element 22 which is connected to the fixed contact 9 of the first toggle switch 8 leads out of the first side face 7*a* at the outlet point 28*a*. The external segment 22*a* of the first connecting element 22 and the external segment 26 of the fifth connecting element 25 each extend along the longitudinal axis L of the coil 3, wherein the external segment 22*a* of the first connecting element 22 and/or the outlet point 28*a* is a shorter distance away from the base face 7*c* than the external segment 26*a* of the fifth connecting element 26 or the outlet point 28*b*, respectively. Furthermore, the external segment 22*a* is shorter along the longitudinal axis of the coil 3, i.e., in −x direction than the external segment 26*a*. The external segments 24*a* of the third connecting element 24 and the external segment 25*a* of the fourth connecting element 25 each extend along the longitudinal axis of the coil 3, i.e., in −x direction, wherein the external segment 25*a* of the fourth connecting element 25 and/or the outlet point 29*a* is/are a shorter distance away from the base face 7*a* than the outlet point 29*b* and/or the external segment 25*a* of the third connecting element 25. Furthermore, the external segment 225 along the longitudinal axis of the coil 3, i.e., in the x direction, is shorter than the external segment 24*a*. The external segments 22*a* and 25*a* as well as the external segments 24*a* and 26*a* are preferably the same length.

The stationary end 12 of the contact spring 11 of the first toggle switch 8 is preferably arranged near the second side face 7*b*, while the contact element 13 which is attached to the movable segment 14 and belongs to the contact spring 11 of the first toggle switch 8 as well as the fixed contacts 9 and 10 of the first toggle switch 8 are preferably arranged in the proximity of the first side face 7*a* and in proximity to the base face 7*c*. The stationary end 20*b* of the contact spring 18 of the second toggle switch is preferably arranged in proximity to the first side face, and the contact element of the movable segment of the contact spring of the second toggle switch as well as the fixed contacts of the second toggle switch are arranged in proximity to the second side face. In this way the contact springs 11 and 18 extend over almost the entire length of the housing which is bordered by the two side faces 7*a* and 7*b*. The two contact springs 11 and 18 may run essentially parallel to one another along the x axis, i.e., the longitudinal axis of the coil 3. In this way contact springs having a great length can be installed and may be arranged at a distance from one another which ensures adequate electrical insulation from one another.

Thanks to this measure, a standard minimum distance of 5.5 mm, for example, between the contacts and/or the external segments of the connecting elements can be maintained without having to change the installation width of the housing 7.

The external segment 22*a* of the first connecting element 22 and the external segment 25*a* of the fourth connecting element 25 may advantageously lie in a first plane running essentially parallel to the base face 7*c*.

Then the external segment 24*a* of the third connecting element 24 and the external segment 26*a* of the fifth connecting element 26 may expediently lie in a second plane running essentially parallel to the base face 7*c*. The first plane is a shorter distance away from the base face 7*c* than the second plane.

As shown in FIG. 1, for example, the external segment 23*a* of the second connecting element 23, which is connected to the other fixed contact 10 of the first toggle switch 8 may lead out of the first side face 7*a* at another outlet point 28*c*. Since the outlet point 28*c* is the shortest distance away from the base face 7*c* in comparison with the outlet points 28*a* and 28*b*, the external segment 23*a* also expediently has the shortest extent in the −x direction in comparison with the external segments 22*a* and 26*a*. Similarly, the external segment 27*a* of the sixth connecting element 27 which is connected to the stationary end 12 of the first toggle switch 8 may lead out of the second side face 7*b* at another outlet point 29*c*. Since the outlet point 29*c* is the shortest distance away from the base face 7*c* in comparison with the outlet points 29*a* and 29*b*, the external segment 27*a* expediently also has the smallest extent in the x direction in comparison with the external segments 25*a* and 24*a*. The largest portion of the external segments 23*a* and 27*a* extends in the insertion direction, i.e., parallel to the side face 7*a* and/or 7*b*. A distance between the external segment 23*a* and the side face 7*a* as well as the distance between the external segment 27*a* and the side face 7*b* preferably approaches zero. Furthermore, the outlet points 28*c* and 29*c* may lie in a third plane which runs essentially parallel to the base face and is a shorter distance away from the base face 7*c* than the second plane.

A symmetrical arrangement of the external segments is obtained when the extent of the external segments 23*a* and 27*a* in −x and x directions, respectively, and the length of external segments 22*a* and 25 as well as the length of external segments 26*a* and 26*a* are each the same. Alternatively, external segments 23*a* and 27*a* could also lead out of the base face 7*c*.

The magnetic system, in particular the coil 3 or the coil core 4, has a first end face 90*a*, which faces the first side face 7*a*, and a second end face 90*b*, which faces the second narrow side 7*b*, such that the first actuator 21*a* is arranged between the first side face 7*a* and the first end face 90*a*, and the second actuator 21*b* is arranged between the second end face 90*b* and the second narrow side 7*b*. The armature 5, which is embodied as a rocker armature, is arranged between the first actuator 21*a* and the second actuator 21*b*.

The coil 3 may be connected in a known way to a seventh connecting element 31 and an eighth connecting element 32. The seventh connecting element 31 has an external segment 31*a* while the eighth connecting element 32 has an external segment 32*a*. The external segments 31*a* and 32*a* may lead out of the base face 7*c* of the housing 7. They preferably extend in the insertion direction, i.e., in −y direction.

The electromechanical relay shown in FIG. 1 preferably has a sandwich structure, i.e., the magnetic system—comprising the armature 5 and the coil 3 in particular—and the contact springs 11 and 18 are arranged in different planes, each of which essentially spans the x and z axes and are arranged at different heights with respect to the y direction. In other words, the armature 5, the coil 3 and the contact springs 11 and 18 each extend in the x direction, as seen along the longitudinal axis of the coil 3.

In addition, the contact springs 11 and 18 are arranged beneath the magnetic system, i.e., between coil 3 and base face 7*c* with respect to the y axis. The armature 5 is situated above the coil 3. As shown in FIG. 1, the contact springs 11 and 18 can be electrically insulated from one another by a partition 60. The partition 60 may be part of the housing 7. The partition 60 may have recesses, through which the actuators 21*a* and 21*b* as well as the coil terminals can be passed.

It should be pointed out here that each connecting element may have an internal segment, which is preferably aligned essentially parallel to the longitudinal axis of the coil 3. Such an internal segment 27*b* is shown with regard to the connecting element 27.

Figure 2:
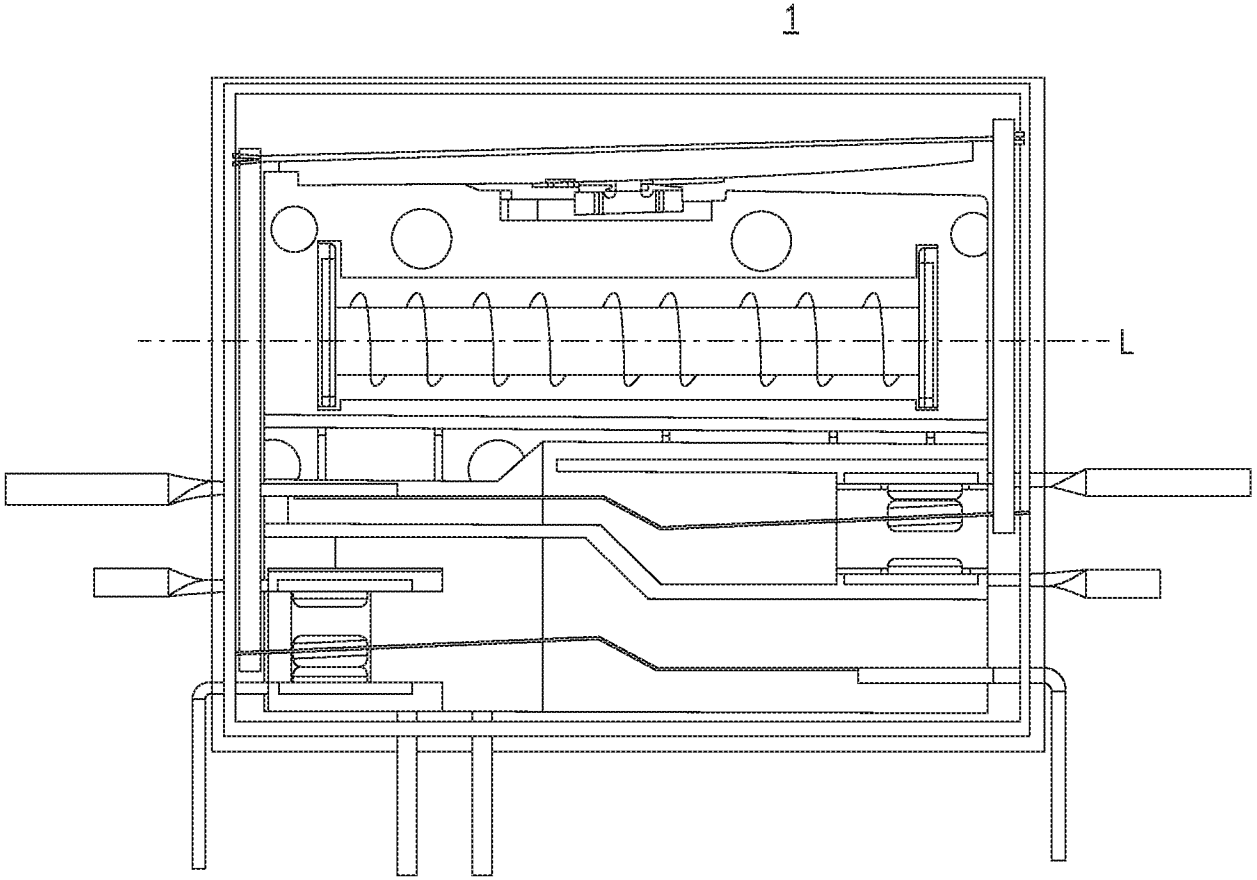
FIG. 2 shows the inventive relay shown in FIG. 1 in a resting position.

FIG. 2 shows the same electromechanical relay 2 illustrated in FIG. 1 but in a second armature position, namely in the resting position. In this case, the coil 3 is currentless, i.e., no voltage is applied to connecting elements 31 and 32. Reset ting of the armature in the resting position can be supported by the stroke-limiting spring 30.

Figure 3:
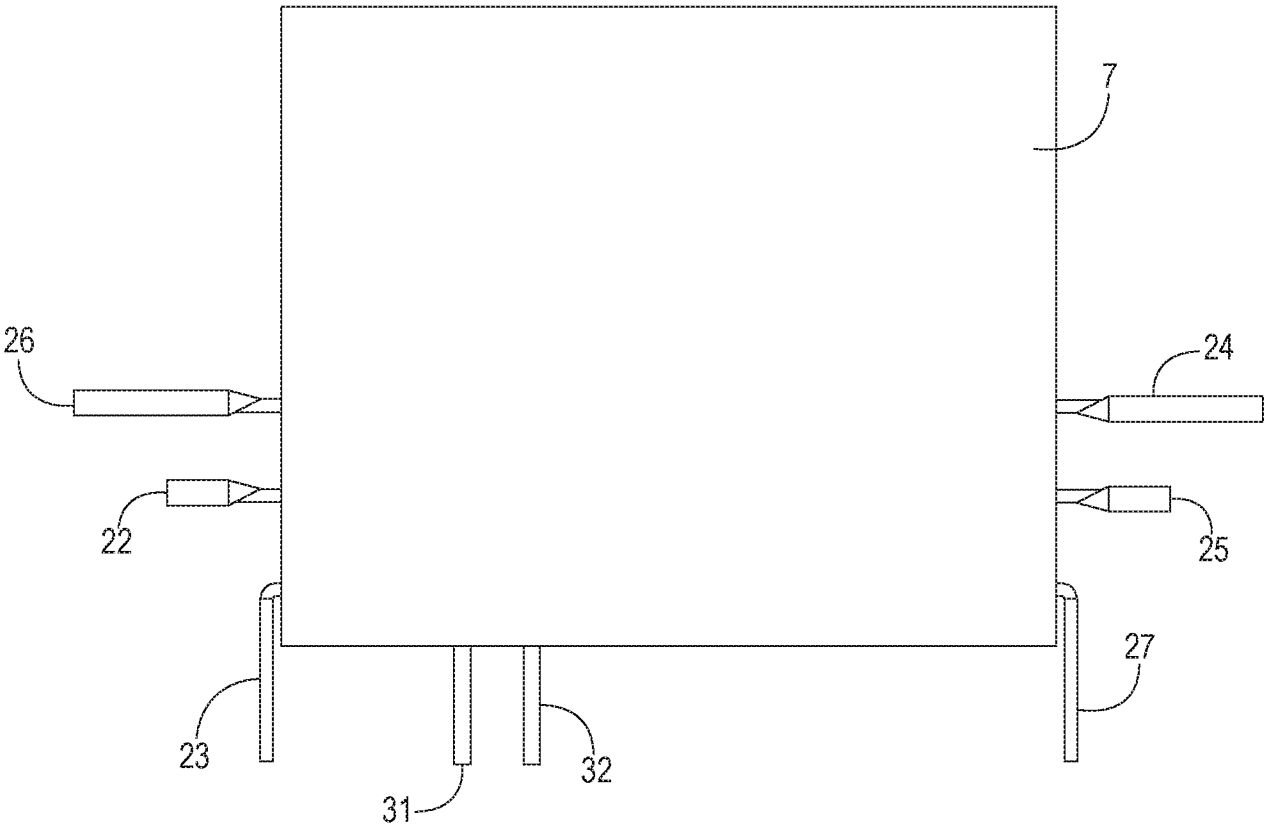
FIG. 3 shows a front view of the relay shown in FIG. 1 with the front wall inserted.

FIG. 3 shows the electromechanical relay illustrated in FIG. 1 in the housing 7 with the front side attached. This shows the external segments of the connecting elements 22 to 27 and 31 and 32.

Figure 5:
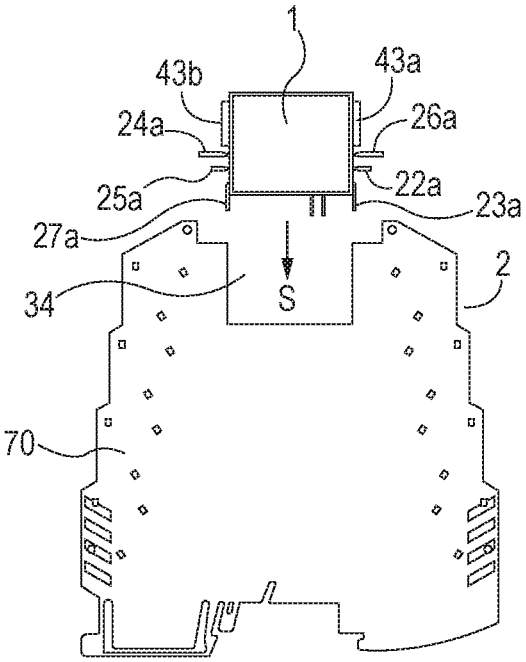
FIG. 5 shows a side view of an electromechanical relay module having the electromechanical relay shown in FIG. 1 and a modular terminal before mounting.

FIG. 5 shows the exemplary modular terminal 2 in a housing 70 in an unmounted condition and the electromechanical relay 1, which is shown in FIG. 3 and is illustrated here rotated by 180° with respect to the insertion direction.

A recess 34 is formed in the housing 33 and is open at the top, i.e., is open in the y direction with regard to the coordinate system shown in FIG. 1, so that the electromechanical relay 1 can be inserted into the modular terminal 2. Guide webs 43*a* and/or 43*b* are provided on the side faces 7*a* and 7*b* and work together with complementary guide grooves 44 in the housing 70, one of which is shown in FIG. 7, while the relay 1 is being inserted into a recess 80 in the modular terminal 2.

Relay 1 and modular terminal 2 form the components of an electromechanical relay module.

Figure 6:
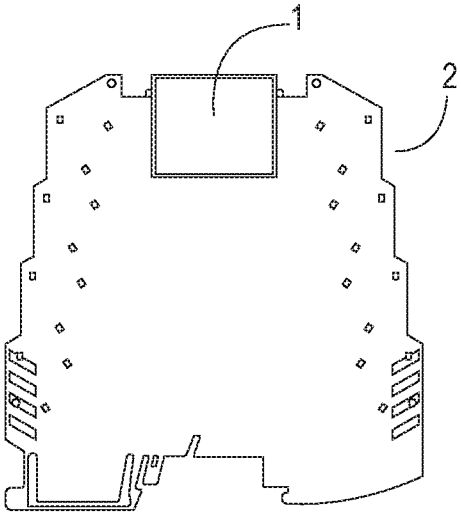
FIG. 6 shows the electromechanical relay module shown in FIG. 5 in the mounted state.

FIG. 6 shows the electromechanical relay module from FIG. 5 in the mounted and/or assembled condition.

FIG. 7 shows as an example the modular terminal 2, from which the front half of the housing has been removed. FIG. 7 shows, among other things, the guide web 43 of the relay housing 7 and a guide groove 44 on a rear housing half 70*a*.

For example, connecting elements 35 and 36 are provided on the rear housing half 70*a* namely in the mounted state in proximity to the first side face 7*a* of the relay housing 7 in the area of the recess 34. These connecting elements are paired with the external segments 26*a* and/or 22*a* of the connecting element 22 and 26 of the relay 1. The connecting elements 35 and 36 are preferably designed as connecting bushings or terminal clamps.

In the inserted state of the electromechanical relay 1, the connecting terminal 35 is located at the level of the external segment 26*a* of the fifth connecting element 26 of the electromechanical relay, and the connecting terminal 36 of the modular terminal 2 is located at the level of the external segment 22 of the first connecting element 22 of the relay 1. In the mounted state, the distance from the connecting terminal 35 to the side face 7*a* of the relay housing 7 is greater than that of the connecting terminal 36. Similarly, in the mounted state, connecting elements 41 and 42 are arranged in proximity to the second side face 7*ba* of the relay housing 7. These connecting elements are paired with the external segments 25*a* and/or 24*a* of the connecting elements of the relay 1. The connecting elements 41 and 42 are preferably designed as connecting bushings or terminals.

In the inserted state of the electromechanical relay 1, the connecting terminal 41 is located at the level of the external segment 22*a* of the connecting element 22 of the electromechanical relay, and the connecting terminal 42 of the modular terminal 2 is located at the level of the external segment 26 of connecting element 26 of relay 1. In the mounted state, the distance from the connecting terminal 42 to the side face 7*b* of the relay housing 7 is greater than that of the connecting terminal 41.

With respect to the y axis of the coordinate system shown in FIG. 1, four connecting bushings 37 through 40 are arranged beneath the base face 7*c* of the relay housing 7 on the rear housing half 70*a* in the mounted state, such that in the mounted state, the external segments 23*a*, 32*a*, 31*a* and 27*a* of the connecting elements of the relay 1 running in the insertion direction are inserted into the corresponding connecting bushings 37, 38, 39 and/or 40.

The connecting bushings 37 to 40 preferably lie in a first plane running beneath and parallel to the base face 7*c* of the relay housing. The connecting terminals 41 and 36 lie in a second plane running parallel to the base face 7*c*. The connecting terminals 35 and 42 lie in a third plane also running parallel to the base face 7*c* but being at a greater distance from the base face 7*c* in the y direction than the second plane. Furthermore, the connecting terminals 42 and 35 are each arranged at a greater distance from the side face 7*a* and/or 7*b* than the connecting terminals 41 and 36. The distances of the connecting terminals 35, 36, 41 and 42 are such that the external segments 23*a*, 22*a*, 27*a* and 25*a* can be guided past the connecting terminals 35, 36, 41 and 42 unhindered on insertion of the relay 1 into the modular terminal 2.

The modular terminal 2 has a plurality of, for example, eight connecting terminals 80 that are accessible from the outside, each being electrically connected to one of the connecting terminals 35 to 42.

The housing 7 of the electromechanical relay and the housing of the modular terminal 2 have essentially the same width, such that the transverse side of the first side face 7*a* and the transverse side of the second side face 7*b* define the width of the relay housing 7. The relay housing 7 preferably has a width of 5 to 6 mm, and the housing of the modular terminal 2 has a width of 6 to 7 mm.

Thanks to the special arrangement of the connecting elements of the electromechanical relay which are guided in at least some segments out of the side faces 7*a* and 7*b* of the relay housing 7, an electromechanical relay having two toggle switches can preferably be accommodated in a standardized housing with a typical width of 5 to 6 mm and installed and electrically contacted in a modular terminal with a housing which typically has a width of 6 to 7 mm.

The invention claimed is:

1. An electromechanical relay (1) for insertion into a modular terminal (2), the relay comprising:

a magnetic system, which has a coil (3) with a longitudinal axis, a coil core (4) and an armature (5), wherein the relay (1) can be inserted into a modular terminal (2) in an insertion direction running perpendicular to the longitudinal axis (L) of the coil (3), such that the armature (5) is mounted, so that it is pivotable into a first position and a second position running perpendicular to the longitudinal axis of the coil (3) and perpendicular to the insertion direction (S), a housing (7) having a first side face (7*a*) and a second side face (7*b*) opposite one another, each arranged perpendicular to the longitudinal axis of the coil (3) and having a longitudinal axis running parallel to the insertion direction (S), a first toggle switch (8) having two fixed contacts (9, 10) and a contact spring (11), such that the contact spring (11) has one stationary end (12) and one segment (14) carrying a contact element (13) that is movable between the two fixed contacts (9, 10), a second toggle switch (15) having two fixed contacts (16, 17) and one contact spring (18), wherein the contact spring (18) has a stationary end (20*b*) and a segment (20) that carries a contact element (19) and is movable between the two stationary contacts (16, 17), wherein the first toggle switch (8) and the second toggle switch (15) are arranged at different locations inside the housing (7) along the longitudinal axes of the first and second side faces (7*a*, 7*b*), and an actuating device (21, 21*a*, 21*b*), which couples the movable segments (14, 20) of the contact springs (11, 18) of the first and second toggle switches (8, 15) to the armature (5) and can be moved along the longitudinal axes of the first and second side faces (7*a*, 7*b*), wherein the one stationary contact (9) of the first toggle switch (8) is connected to a first connecting element (22), the other fixed contact (10) of the first toggle switch (8) is connected to a second connecting element (23), the one fixed contact (16) of the second toggle switch (15) is connected to a third connecting element (24), the other fixed contact (17) of the second toggle switch (15) is connected to a fourth connecting element (25), the stationary end (20*b*) of the contact spring (18) of the second toggle switch (15) is connected to a fifth connecting element (26), the stationary end (12) of the contact spring (11) of the first toggle switch (8) is connected to a sixth connecting element (27), and wherein the coil (3) is connected to a seventh and eighth connecting element (31, 32), wherein the connecting elements (22 to 27, 31, 32) each have an external segment (22*a* to 27*a*, 31*a*, 32*a*) situated outside of the housing (7), wherein at least one of the connecting elements (22 to 27, 31, 32) has an external segment (22*a* to 27*a*, 31*a*, 32*a*) situated outside of the housing (7), such that at least one of the connecting elements (22 to 27, 31, 32) leads out of the first side face (7*a*) and at least one additional connecting element (22 to 27, 31, 32) leads out of the second side face (7*b*), or at least one of the connecting elements (22 to 27, 31, 32) leads out of one of the two side faces (7*a*, 7*b*).

2. The electromechanical relay according to claim 1, wherein:

the housing (7) has a base face (7*c*) adjacent to the first and second side faces (7*a*, 7*b*) and arranged perpendicular to the insertion direction;

at least two of the connecting elements (22, 26) lead out of the first side face (7*a*) at separate outlet points (28*a*, 28*b*), and at least two other connecting elements (24, 25) lead out of the second side face (7*b*) at separate outlet points (29*a*, 29*b*);

the external segments (22*a*, 26*a*, 24*a*, 25*a*) of the connecting elements (22, 26, 24, 25) lead out of the first and second side faces (7*a*, 7*b*), each extending along the longitudinal axis of the coil (3) in at least some segments;

the separate outlet points (28*a*, 28*b*) of the first side face (7*a*) are different distances away from the base face (7*c*);

the separate outlet points (29*a*, 29*b*) of the second side face (7*b*) are at different distances away from the base face (7*c*);

the external segments (22*a*, 26*a*) of the connecting elements (22, 26) lead out of the first side face (7*a*), each having an extent along the longitudinal axis (L) of the coil (3), which increases with the distance of the outlet points (28*a*, 28*b*) of the first side face (7*a*) from the base face (7*c*); and the external segments (24*a*, 25*a*) of the connecting elements (24, 25) lead out of the second side face (7*b*), each having an extent along the longitudinal axis of the coil (3) that increases with the distance of the outlet points (29*a*, 29*b*) of the second side face (7*b*) from the base face (7*c*).

3. The electromechanical relay according to claim 1, wherein:

the distance from the base face (7*c*) to the first toggle switch (8) is less than the distance from the base face (7*c*) to the second toggle switch (15);

the fifth connecting element (26), which is connected to the stationary end (20*b*) of the contact spring (18) of the second toggle switch (15), leads out of the first side face (7*a*);

the third connecting element (24), which is connected to one of the fixed contacts (16) of the second toggle switch (15), leads out of the second side face (7*b*);

the fourth connecting element (25), which is connected to the other fixed contacts (17) of the second toggle switch (15), leads out of the second side face (7*b*);

the first connecting element (22), which is connected to one of the fixed contacts (9) of the first toggle switch (8), leads out of the first side face (7*a*);

the external segments (22*a*, 26*a*) of the first and fifth connecting elements (22, 26) each extend along the longitudinal axis of the coil (3), wherein the external segment (22*a*) of the first connecting element (22) is a shorter distance away from the base face (7*c*) than the external segment (26*a*) of the fifth connecting element (26), and wherein the external segment (22*a*) of the first connecting element (22) along the longitudinal axis (L) of the coil (3) is shorter than the external segment (26*a*) of the fifth connecting element (26);

the external segments (24*a*, 25*a*) of the third and fourth connecting elements (24, 25) each extend along the longitudinal axis of the coil (3), wherein the external segment (25*a*) of the fourth connecting element (25) is a shorter distance away from the base face (7*c*) than the external segment (24*a*) of the third connecting element (24), and wherein the external segment (25*a*) of the fourth connecting element (25) along the longitudinal axis of the coil (3) is shorter than the external segment (24*a*) of the third connecting element (24).

4. The electromechanical relay according to claim 3, wherein:

the stationary end (12) of the contact spring (11) of the first toggle switch (8) is arranged in proximity to the second side face (7*b*), and the contact element (13) of the contact spring (11) of the first toggle switch (8) being attached to the movable segment (14) as well as the fixed contacts (9, 10) of the first toggle switch (8) are arranged in proximity to the first side face (7*a*);

the stationary end (20*b*) of the contact spring (18) of the second toggle switch (15) is arranged in proximity to the first side face (7*a*), and the contact element (19) of the contact spring (18) of the second toggle switch (15), said contact element being attached to the movable segment (20), as well as the fixed contacts (16, 17) of the second toggle switch (15) are arranged in proximity to the second side face (7*b*).

5. The electromechanical relay according to claim 3, wherein:

the external segments (22*a*, 25*a*) of the first and fourth connecting elements (22, 25) lie in a first plane running essentially parallel to the base face (7*c*);

the external segments (24*a*, 26*a*) of the third and fifth connecting elements (24, 26) lie in a second plane running essentially parallel to the base face (7*c*) and the first plane is a shorter distance away from the base face (7*c*) than the second plane.

6. The electromechanical relay according to claim 5, wherein:

the external segment (23*a*) of the second connecting element (23), which is connected to the other fixed contact (10) of the first toggle switch (8), leads out of the first side face (7*a*) at another outlet point (28*c*) and extends in the insertion direction;

the external segment (27*a*) of the sixth connecting element (27), which is connected to the stationary end (12) of the contact spring (11) of the first toggle switch (8), leads out of the second side face (7*b*) at another outlet point (29*c*) and extends in the insertion direction;

the additional outlet points (28*c*, 29*c*) lie in a third plane running essentially parallel to the base face (7*c*);

the third plane is a shorter distance away from the base face (7*c*) than the first plane.

7. The electromechanical relay according to claim 5, wherein the external segment (23*a*) of the second connecting element (23) and the external segment (27*a*) of the sixth connecting element (27) lead out of the base face (7*c*).

8. The electromechanical relay according to claim 2, wherein:

the actuating device (21) has a first and second actuator (21*a*, 21*b*), wherein the first actuator (21*a*) is connected to the movable segment (14) of the contact spring (11) of the first toggle switch (8), and the second actuator (21*b*) is connected to the movable segment (20) of the contact spring (18) of the second toggle switch (15);

the magnetic system has an end face (90*a*) that faces the first side face (7*a*) and a second end face (90*b*) that faces the second side face (7*b*);

the first actuator (21*a*) is arranged between the first side face (7*a*) and the first end face (90*a*) of the magnetic system, and the second actuator (21*b*) is arranged between the second end face (90*b*) and the second side (7*b*); and the armature (5) is arranged between the first and second actuators (21*a*, 21*b*) and has a stroke-limiting spring (30), the ends of which are engaged with the first and/or second actuators (21*a*, 21*b*).

9. The electromechanical relay according to claim 1, wherein the external segments (31*a*, 32*a*) of the seventh and eighth connecting elements (31, 32) lead out of the base face (7*c*) of the housing and extend in the insertion direction.

10. The electromechanical relay according to claim 1, wherein the armature (5), the coil (3) and the contact spring (11, 18) are arranged in a sandwich structure, and each has an elongated extent along the longitudinal axis of the coil (3).

11. A modular terminal (2) for accommodating an electromechanical relay (1) according to claim 1, the modular terminal comprising:

a housing (70) with a recess (34), which is designed to accommodate the relay (1), wherein connecting elements (35-42) are arranged in the recess, said elements being designed for electrical coupling to the external segments (22*a*-27*a*, 31*a*, 32*a*) of the connecting element (22-27, 31, 32) of the relay (1).

12. The electromechanical relay module comprising a modular terminal (2) and an electromechanical relay (1) according to claim 1, the modular terminal (2) comprising a housing (70) with a recess (34), which is designed to accommodate the relay (1), wherein connecting elements (35-42) are arranged in the recess, said elements being designed for electrical coupling to the external segments (22*a*-27*a*, 31*a*, 32*a*) of the connecting element (22-27, 31, 32) of the relay (1), wherein guide elements (43*a*, 43*b*), which cooperate with complementary guide elements (44) on the housing (70) of the modular terminal (2) on insertion of the relay (1) into the modular terminal (2), are arranged on the first and/or second side faces (7*a*, 7*b*) of the relay housing.

13. The electromechanical relay module according to claim 12, wherein the housing (7) of the electromechanical relay (1) and the housing (70) of the modular terminal (2) are essentially equal in width, such that the transverse axis of the first and second side faces (7*a*, 7*b*) each define the width of the housing (7) of the electromechanical relay (1).

14. The electromechanical relay module according to claim 13, wherein the housing (7) of the electromechanical relay (19) is 5 to 6 mm wide and the housing (70) of the modular terminal (2) is 6 to 7 mm wide.

* * * * *